United States Patent [19]

Jost

[11] 4,456,473

[45] Jun. 26, 1984

[54] METHOD OF MAKING SILVER POWDER

[75] Inventor: Ernest M. Jost, Plainville, Mass.

[73] Assignee: Chemet Corporation, Attleboro, Mass.

[21] Appl. No.: 491,805

[22] Filed: May 5, 1983

[51] Int. Cl.[3] ..... B22F 9/00

[52] U.S. Cl. ..... 75/0.5 A; 75/109

[58] Field of Search ..... 75/0.5 A, 109, 118 R, 75/118 P

[56] References Cited

U.S. PATENT DOCUMENTS

| | | | |
|---|---|---|---|
| 2,796,343 | 6/1957 | Shaw et al. | 75/109 |
| 3,334,995 | 8/1967 | Gaspar | 75/118 R |
| 3,369,886 | 2/1968 | Metzger et al. | 75/0.5 |
| 3,390,981 | 7/1968 | Hoffman | 75/108 |
| 3,427,153 | 2/1969 | Venkatesan et al. | 75/108 |
| 3,620,713 | 11/1971 | Short | 75/0.5 A |
| 3,694,254 | 9/1972 | Blumenthal | 75/0.5 A |
| 4,129,441 | 12/1978 | Kunda et al. | 75/0.5 A |

FOREIGN PATENT DOCUMENTS

| | | | |
|---|---|---|---|
| 52-54661 | 5/1977 | Japan | 75/0.5 A |
| 1343004 | 1/1974 | United Kingdom | 75/0.5 A |

*Primary Examiner*—Michael L. Lewis

[57] ABSTRACT

Silver powder of high purity having a particle size from 3 to 5 micrometers in diameter is made by providing a solution of silver nitrate in deionized water containing excess ammonium hydroxide, spraying into the solution while stirring it an aqueous solution of hydrazine in deionized water in an amount in excess of that theoretically required to reduce the silver nitrate to silver metal.

2 Claims, No Drawings

METHOD OF MAKING SILVER POWDER

This invention relates to the manufacture of silver powder of high purity and of a particle size within the range 3 to 5 micrometers in diameter, and pertains more specifically to reduction of aqueous silver nitrate solution in the presence of excess ammonia by spraying into the solution an aqueous solution by hydrazine under controlled conditions.

The reaction proceeds in accordance with the following equation:

$$AgNO_3+(NH_4)OH+\tfrac{1}{4}N_2H_4 \rightarrow Ag+(NH_4)NO_3+\tfrac{1}{2}N_2+2H_2O$$

The conditions under which the reaction is carried out are critical to obtaining the desired results. Silver nitrate, deionized water and ammonia are mixed to provide a solution containing 1 to 8 M silver nitrate, preferably 3 to 6 M, and a large excess of ammonia above the amount theoretically required for the reaction, the mole ratio of ammonium hydroxide to silver nitrate being from 2:1 to 3:1, preferably 2:1 to 2.5:1. The reaction solution is stirred and there is sprayed into it a 0.5 M to 11 M solution of hydrazine, preferably 1 to 5 M, in deionized water, the amount of hydrazine being in excess of the amount theoretically required, the amount of hydrazine solution being sufficient to provide a mole ratio of hydrazine to silver nitrate from 0.25:1 to 0.5:1. Stirring is continued for approximately ½ hour to ensure completion of the reaction after which the silver powder is separated by filtration, washed with deionized water and dried. The product is a silver powder of high purity, substantially free from alkali metal and chloride.

The large grain powder of the present invention is useful for the manufacture of electronic silver flakes, resulting in products of low viscosity when mixed with the appropriate resins to form conductive polymer mixes of high electrical conductivity.

EXAMPLE

In order to produce 1,000 ounces of coarse silver powder, there were mixed together at room temperature 25.5 gallons of 6 molar aqueous ammonium hydroxide (576 moles), 70 gallons of deionized water, and 25.3 gallons of a 3 molar solution of silver nitrate in deionized water (288 moles). The mixture was stirred together in a 280 gallon reaction vessel using a 10-inch propeller stirrer revolving at 350 rpm.

After thorough stirring of this mixture, there was introduced by spraying through a type HD nozzle (Spray Systems, Inc., Wheaton, Ill.) at a back pressure of at least 40 psi., 7.3 gallons of a 3 molar solution of hydrazine in deionized water (83 moles), thus providing an excess of approximately 15% of hydrazine above the amount theoretically required.

After continued stirring at room temperature for approximately ½ hour, the reaction was complete and the silver powder was separated from the mixture by an industrial filter nutsch. The powder was washed with 200 gallons of deionized water and dried in a vacuum oven. The resulting powder had a grain size of 3.5 micrometers in diameter, very low surface area, relatively low sinter density (85% of theoretical) when cold pressed at 5,000 psi. and sintered at 1650° F. for approximately ½ hour Analysis showed the powder to contain less than 2 ppm of sodium and potassium and less than 5 ppm of chloride; all other metallic impurities totalled less than 5 ppm.

What is claimed is:

1. The method of making silver powder of high purity having a particle size from 3 to 5 micrometers in diameter which comprises providing a 1 to 8 molar silver nitrate solution in deionized water containing ammonium hydroxide in which the mole ratio of ammonium hydroxide to silver nitrate is from 2:1 to 3:1, stirring said solution, spraying into said solution during stirring a 0.5 to 11 molar solution of hydrazine in deionized water to provide a mole ratio of hydrazine to silver nitrate from 0.25:1 to 0.5:1, separating precipitated silver powder from the solution by filtration, washing said silver powder with deionized water, and drying said powder.

2. The method as claimed in claim 1 in which said silver nitrate solution is from 3 to 6 molar, the molar ratio of ammonium hydroxide to silver nitrate is from 2:1 to 2.5:1, the concentration of the hydrazine solution is 1 to 5 molar, and the molar ratio of silver nitrate to hydrazine is approximately 0.29:1.

* * * * *